US010301756B2

(12) United States Patent
Lv et al.

(10) Patent No.: US 10,301,756 B2
(45) Date of Patent: May 28, 2019

(54) DUAL-DRUM WASHING MACHINE

(71) Applicants: HAIER GROUP CORPORATION, Qingdao, Shandong (CN); QINGDAO HAIER DRUM WASHING MACHINE CO., LTD., Qingdao, Shandong (CN)

(72) Inventors: Peishi Lv, Shandong (CN); Wenwei Li, Shandong (CN); Jinkai Wang, Shandong (CN); Jun Wu, Shandong (CN)

(73) Assignees: HAIER GROUP CORPORATION, Qingdao, Shandong (CN); QINGDAO HAIER DRUM WASHING MACHINE CO., LTD., Qingdao, Shandong (CN)

( * ) Notice: Subject to any disclaimer, the term of this patent is extended or adjusted under 35 U.S.C. 154(b) by 493 days.

(21) Appl. No.: 14/903,539

(22) PCT Filed: Dec. 24, 2013

(86) PCT No.: PCT/CN2013/001638

§ 371 (c)(1),
(2) Date: Jan. 7, 2016

(87) PCT Pub. No.: WO2015/003293

PCT Pub. Date: Jan. 15, 2015

(65) Prior Publication Data

US 2016/0160420 A1 Jun. 9, 2016

(30) Foreign Application Priority Data

Jul. 9, 2013 (CN) ..... 2013 1 0284842
Jul. 9, 2013 (CN) ..... 2013 1 0285065
(Continued)

(51) Int. Cl.
*D06F 31/00* (2006.01)

(52) U.S. Cl.
CPC ..... *D06F 31/00* (2013.01)

(58) Field of Classification Search
CPC ..... D06F 31/00
(Continued)

(56) References Cited

U.S. PATENT DOCUMENTS 4,236,393 A * 12/1980 Katzfey ..... D06F 31/005 68/27
5,025,645 A * 6/1991 Eck ..... D06F 37/00 68/140
2010/0269266 A1 10/2010 Lee et al.

FOREIGN PATENT DOCUMENTS

CN 2441827 Y * 8/2001
CN 2441827 Y 8/2001
(Continued)

OTHER PUBLICATIONS

State Intellectual Property Office of the P.R. China (ISR/CN), "International Search Report for PCT/CN2013/001638", China, dated Apr. 16, 2014.

*Primary Examiner* — Michael E Barr
*Assistant Examiner* — Tinsae B Ayalew
(74) *Attorney, Agent, or Firm* — Tim Tingkang Xia, Esq.; Locke Lord LLP

(57) ABSTRACT

A dual-drum washing machine includes a first outer drum and a second outer drum mounted in a frame, wherein the first outer drum is connected to the second outer drum via a connector to form an integral structure. The first outer drum and the second outer drum connected to each other are connected to the frame (1) via a shared damping apparatus. The damping apparatus has a first damping device used for connecting the first outer drum to the frame, a second damping device used for connecting the second outer drum to the frame, and a third damping device used for connecting
(Continued)

the first outer drum or the second outer drum to a middle cross beam which is disposed on the frame.

6 Claims, 15 Drawing Sheets

(30) Foreign Application Priority Data

Jul. 9, 2013 (CN) ..... 2013 1 0289777
Jul. 9, 2013 (CN) ..... 2013 1 0290147
Jul. 9, 2013 (CN) ..... 2013 1 0290210

(58) Field of Classification Search
USPC ..... 68/27
See application file for complete search history.

(56) References Cited

FOREIGN PATENT DOCUMENTS

| | | | |
|---|---|---|---|
| CN | 1880557 | A | 12/2006 |
| CN | 101113557 | B | 1/2008 |
| CN | 101886320 | A | 11/2010 |
| DE | 19522438 | A1 | 1/1997 |
| EP | 0825291 | A1 | 11/2001 |
| EP | 1195911 | A2 | 4/2002 |
| WO | 0212609 | A1 | 2/2002 |

* cited by examiner

DUAL-DRUM WASHING MACHINE

CROSS-REFERENCE TO RELATED APPLICATIONS

This application claims priority to and benefit of Chinese Patent Application Nos. 201310285065.0, 201310289777.X, 201310290210.4, 201310284842.X and 201310290147.4, all filed Jul. 9, 2013 in the State Intellectual Property Office of P.R. China, which are incorporated herein by reference in their entireties.

FIELD OF THE INVENTION

The present invention relates generally to the field of washing machines, and more particularly, to a dual-drum washing machine.

BACKGROUND OF THE INVENTION

A washing machine is a house appliance used for washing clothes, and a drying machine is a house appliance used for drying clothes. In recent years, washing-drying integral machines integrating functions of washing and drying have been widely used. In the following, for ease of illustration, the washing machine, the drying machine, and the washing-drying integral machine integrating the functions of washing and drying are collectively referred to as a washing machine.

The washing machines are generally classified into an impeller type of washing machines and a drum type of washing machines. In an impeller type washing machine, a motor shaft and a washing drum shaft are generally disposed vertically, and the washing machine is of a top-opening type. In a drum type washing machine, a motor shaft and a washing drum shaft are generally disposed horizontally, and the washing machine is of a top-opening type or a front-opening type. A conventional drum type washing machine is generally of the front-opening type, and is directly mounted on the ground for use. For such a front-opening type washing machine, a cloth feed opening is positioned in a low position, which causes a lot of inconveniences for a user to put clothes into the washing machine or taking clothes out of the washing machine.

Generally, each family has only one washing machine. In order to wash clothes of different types, the washing machine needs to be used or started for several times. For example, the clothes may be classified into adult's clothes, underwear, and children's clothes. For washing these clothes, the washing machine needs to be used twice, thereby, consuming a lot of washing time and energy. In addition, in consideration of energy saving, it is not preferred to use the large-scale washing machine in the prior art to wash a small amount of clothes. A washing procedure set in the large-scale washing machine generally consumes a large amount of water and a large amount of power.

Moreover, the expected amount of clothes in the washing procedure is large, so the washing time is long. In addition, washing procedures set in the large-scale washing machine generally are for general clothes, and may not be suitable for washing fine clothes such as underwear or children's clothes. Further, the large-scale washing machine is also not applicable to washing a small amount of clothes frequently. A consumer may collect clothes for days or more before washing clothes of an appropriate load. In consideration of health, it is profitless to place underwear, children's clothes and similar objects for a long time. If the clothes are placed for a long time, dirt will be adhered to the clothes and will be hard to be completely cleaned.

Therefore, on the basis of providing a conventional large-scale washing machine, the necessity of additionally disposing a small-scale washing machine with a much small capacity is increased. However, although the washing machine is small-sized, it is not preferred to dispose two washing machines in one family in consideration of space utilization. Therefore, some patents provide technical solutions:

For example, Chinese Patent Application No. 200810109942.8 entitled "Washing Machine" provides a washing machine that can wash or dry clothes. The washing machine includes a first washing drum, configured to accommodate clothes; a shell, the first washing drum being located in the predetermined space in the shell; a second washing drum, disposed in the shell, and configured to accommodate clothes in a manner of being separated from the first washing drum; and a supporting member, configured to support the second washing drum with respect to the shell, basically block the shift of the second washing drum due to the load of the second washing drum, and limit the vibration shift of the second washing drum in a predetermined amplitude. However, in the technical solution, the two washing drums are not connected to each other, and a gap between the two is large, which increases the volume of the washing machine. Moreover, in the existing dual-drum washing machine, the first washing drum and the second washing drum are each connected to a separately disposed damping mechanism, which not only increases the number of parts of the washing machine, but also increases the volume and weight of the washing machine.

Therefore, a heretofore unaddressed need exists in the art to address the aforementioned deficiencies and inadequacies.

SUMMARY OF THE INVENTION

One of the objectives of the present invention is to provide a dual-drum washing machine to solve the foregoing deficiencies.

In one aspect of the present invention, the dual-drum washing machine includes a first outer drum and a second outer drum mounted in a frame of the washing machine where the first outer drum is connected to the second outer drum through a connector to form an integral structure, and the first outer drum and the second outer drum connected to each other are connected to the frame through a shared damping apparatus.

In one embodiment, the damping apparatus includes a first damping device used to connect the first outer drum to the frame, a second damping device used to connect the second outer drum to the frame, and a third damping device used to connect the first outer drum or second outer drum to a middle cross beam disposed on the frame.

In one embodiment, the first damping device is a spring connected to the upper portion of the first outer drum, and the spring is connected to the frame; and the second damping device is at least one damper connected to the lower portion of the second outer drum, and the damper is connected to the frame.

In one embodiment, the third damping device is a spring connected to the upper portion of the second outer drum, and the spring is connected to the middle cross beam of the frame.

In one embodiment, the third damping device is at least one damper connected to the lower portion of the first outer drum, and the damper is connected to the middle cross beam of the frame.

In one embodiment, the first damping device is a spring connected to the upper portion of the first outer drum, and the spring is connected to the frame; the second damping device is a spring connected to the upper portion of the second outer drum, and the spring is connected to the frame; and the third damping device is at least one damper connected to the lower portion of the first outer drum, and the damper is connected to the middle cross beam of the frame.

In one embodiment, the first damping device is at least one damper connected to the lower portion of the first outer drum, and the damper is connected to the frame; the second damping device is at least one damper connected to the lower portion of the second outer drum, and the damper is connected to the frame; and the third damping device is a spring connected to the upper portion of the second outer drum, and the spring is connected to the middle cross beam of the frame.

In one embodiment, the springs are disposed symmetrically with respect to a plane where axes of the first outer drum and the second outer drum are located. At the same time, the axes of the springs are all disposed on a center of gravity cross section of the first outer drum and the second outer drum.

In one embodiment, an angle formed by the spring and the vertical beam is set to 30-70 degrees. Therefore, an intersection of axes of two springs disposed symmetrically is located on the plane where the axes of the first outer drum and the second outer drum are located.

In one embodiment, the second outer drum is connected to the frame with three dampers. Connections points of the three dampers and the frame of the washing machine form three vertexes of an isosceles triangle.

In one embodiment, the first outer drum is connected to the middle cross beam with three dampers. Connections points of the three dampers and the middle cross beam form three vertexes of an isosceles triangle.

Preferably, a damper is connected to each of two ends of a beam at one side of the frame, and a damper is connected at the center of a symmetric beam at the other side. Therefore, an arrangement structure in which connection points of the dampers used for supporting the first outer drum and/or second outer drum and the frame form three vertexes of an isosceles triangle is implemented, thereby achieving the effect of stably supporting the first outer drum and the second outer drum.

In one embodiment, connection points of the damper form three vertexes of an equilateral triangle.

In one embodiment, an angle formed by the damper and the vertical beam is set to 30-70 degrees. Therefore, a supporting center of the damper is located on the plane where the axes of the first outer drum and the second outer drum are located, thereby achieving the objective of stably supporting the first outer drum and the second outer drum.

The present invention uses one set of damping apparatuses to damp the first outer drum and the second outer drum, the number of components of the washing machine is relatively reduced, thereby reducing the production cost. More specifically, in the present invention, the middle cross beam is disposed at the middle portion of each side of the frame, so as to connect the first outer drum and second outer drum integrated together to the middle cross beam with the third buffering apparatus, thereby enhancing the reinforcement effect of the outer drum of the washing machine. The dual-drum washing machine of the present invention has a simple structure and significant effect, and is suitable for widespeard use.

In another aspect of the present invention, a dual-drum washing machine includes: a washing machine frame, and a first outer drum and a second outer drum mounted in the frame, where a counterweight mounting column configured to mount a clump weight is integrated on the first outer drum and the second outer drum; the first outer drum is integrated to the second outer drum through a connector; and the connector is fixedly connected to the counterweight mounting column on the first outer drum and/or the second outer drum.

In one embodiment, the connector is a clump weight shared by the first outer drum and the second outer drum.

In another embodiment, the connector is provided with a clump weight shared by the first outer drum and the second outer drum.

In one embodiment, a front end portion of the first outer drum and a front end portion of the second outer drum are both provided with at least one counterweight mounting column fixedly mounted to the connector.

In one embodiment, two ends of the connector are U-shaped limiting junctions matching with profiles of the first outer drum and the second outer drum, the whole connector is H-shaped or X-shaped, and the two limiting ends of the U-shaped limiting junction are fixedly connected to the counterweight mounting column of the first outer drum or second outer drum in a detachable manner.

In another embodiment, an alternative solution is that, one end of the connector is integrated with the first outer drum or the second outer drum, extends outwards from the front end portion of the first outer drum or the second outer drum, and the end of the extension is fixedly connected to the counterweight mounting column at the front end portion of the other outer drum in a detachable manner.

In yet another embodiment, an alternative solution is that, one end of the connector is fixedly connected to the front end portion of the first outer drum or the second outer drum with at least one counterweight mounting column, the other end of the connector is fixedly connected to the front end portion of the second outer drum or the first outer drum with at least two counterweight mounting columns. Preferably, one end of the connector is fixedly connected to the first outer drum or the second outer drum with one counterweight mounting column, and the other end of the connector is fixedly connected to the second outer drum or the first outer drum with two counterweight mounting columns. Three points has stability, and preferably, the design is symmetric along the plane where an axis of the first outer drum or the second outer drum is located, so that the center of gravity is more stable.

In one embodiment, the connector includes at least two sub-connectors, and each sub-connector is connected to both the first outer drum and the second outer drum.

In one embodiment, at least one sub-connector is connected to the front end portions of the first outer drum and the second outer drum, and the front end portions of the first outer drum and the second outer drum are connected with one or more sub-connectors. Preferably, a first sub-connector and a second sub-connector that are disposed at the front portion of the first outer drum and are symmetric about a line of centers of the two outer drums are respectively connected to the second outer drum.

In one embodiment, the counterweight mounting column is disposed at a front flange of the first outer drum and/or second outer drum, the connector is provided with a mounting hole corresponding to the counterweight mounting column, and the counterweight mounting column penetrates through the mounting hole and is fixed with a bolt.

In one embodiment, the rear end portion of the first outer drum and the rear end portion of the second outer drum are connected with another rear end connector.

In one embodiment, to implement balancing of the first outer drum and the second outer drum, an assistant clump weight is disposed on the first outer drum or/and the second outer drum, and the assistant clump weight matches with the shared clump weight to balance the first outer drum and the second outer drum.

In one embodiment, the first outer drum and the second outer drum are each provided with a counterweight mounting column fixedly connected to the connector. Preferably, the counterweight mounting column is in an irregular shape preventing the outer drum from rotating relative to the connector, for example, it is a dentiform or polygonal structure.

In the dual-drum washing machine of the present invention, the first outer drum and the second outer drum are connected as a whole with the connector, so as to effectively improve the compactness of the washing machine. The connector is fixedly mounted and connected by using the counterweight mounting column on the first outer drum or the second outer drum so as to improve the stability thereof; moreover, the connector or the clump weight mounted on the connector is used as a shared counterweight of the first outer drum and the second outer drum. More specifically, after the two outer drums are connected as a whole, the damping effect is significant, and the working noise is reduced. By means of the above apparatus, the objective of the washing machine using the first outer drum and/or second outer drum to wash clothes is implemented, and meanwhile, the compactness of the washing machine is effectively improved, and the space is used rationally. The dual-drum washing machine of the present invention has a simple structure and significant effect, and is suitable for widespeard use.

In the present invention, the counterweight mounting column of the prior art on the first outer drum and the second outer drum is connected to the connector, thereby implementing that the two outer drums are connected to form an integral structure, the connector is mounted at the front end, which reduces the mounting distance between the two outer drums, thereby reducing the overall height of center of gravity of the two outer drums, and increasing the stability. Meanwhile, the occupation space inside the washing machine is reduced, the volume of the washing machine is relatively reduced, and the production cost and transportation cost are further reduced.

In one aspect of the present invention, a dual-drum washing machine includes: a washing machine frame, and a first outer drum and a second outer drum mounted in the frame, where the first outer drum and the second outer drum are each provided with a drum; the first outer drum and the second outer drum are connected as a whole with a connector; and the first outer drum or the second outer drum is provided with at least one connection base point fixedly mounted to the connector.

In one embodiment, the first outer drum and the second outer drum are each provided with at least two connection base points fixedly connected to the connector. Preferably, the first outer drum and the second outer drum are each provided with two connection base points fixedly connected to the connector.

In one embodiment, two ends of the connector are respectively fixedly connected to the connection base points disposed at the front end portion of the first outer drum and the front end portion of the second outer drum in a detachable manner.

In one embodiment, two ends of the connector are U-shaped limiting junctions matching with profiles of the first outer drum and the second outer drum, the whole connector is H-shaped or X-shaped, and the two limiting ends of the U-shaped limiting junction are each provided with a mounting point correspondingly connected to the connection base point of the first outer drum or the second outer drum. Preferably, the two limiting ends are provided with mounting points symmetrically, and the outer drums are provided with connection base points.

In another embodiment, an alternative solution is that, one end of the connector is integrated with the first outer drum or the second outer drum, and the other end of the connector is connected to the second outer drum or the first outer drum.

In one embodiment, the connector extends outwards from the front end portion of the first outer drum or the second outer drum, the end of the extension is fixedly connected to the front end portion of the other outer drum in a detachable manner, and preferably, they are connected with a bolt.

In another embodiment, an alternative solution is that, one end of the connector is fixedly connected to the first outer drum or the second outer drum with at least one connection base point, the other end of the connector is fixedly connected to the second outer drum or the first outer drum with at least two connection base points. Preferably, one end of the connector is fixedly connected to the first outer drum or the second outer drum with one connection base point, and the other end of the connector is fixedly connected to the second outer drum or the first outer drum with two connection base points. Three points has stability, and preferably, the design is symmetric along the plane where an axis of the first outer drum or the second outer drum is located, so that the center of gravity is more stable.

In one embodiment, the connection base point of the first outer drum or the second outer drum is a counterweight mounting column protruding from the surface of the outer drum, the connector is provided with a mounting hole corresponding to the counterweight mounting column, and the counterweight mounting column penetrates through the mounting hole and is fixed with a bolt.

In one embodiment, the connector includes at least two sub-connectors, and each sub-connector is connected to the first outer drum and the second outer drum.

In one embodiment, at least one sub-connector is connected to the front end portions of the first outer drum and the second outer drum, and the front end portions of the first outer drum and the second outer drum are connected with one or more sub-connectors. Preferably, a first sub-connector and a second sub-connector that are disposed at the front portion of the first outer drum and are symmetric about a line of centers of the two outer drums are respectively connected to the second outer drum.

In one embodiment, the connector includes a front connector that connects the front end portions of the first outer drum and the second outer drum, and there is at least one front connector.

In one embodiment, when there is one front connector, the front connector is fixedly connected to two connection base points of the first outer drum and the second outer drum respectively; when there are two front connectors, each front connector is fixedly connected to at least one connection base point of the first outer drum and the second outer drum, and the front connectors are disposed symmetrically about the line of centers of the two outer drums.

In one embodiment, the front connector is a clump weight shared by the first outer drum and the second outer drum, or is provided with a clump weight shared by the first outer drum and the second outer drum.

In one embodiment, the connector includes a rear connector that connects rear end portions of the first outer drum and the second outer drum.

In one embodiment, the front connector and the rear connector are integral structures, and an intermediate portion is disposed integrally between them.

In one embodiment, to implement balancing of the first outer drum and the second outer drum, an assistant clump weight is disposed on the first outer drum or/and the second outer drum, and the assistant clump weight matches with the shared clump weight to balance the first outer drum and the second outer drum.

In one embodiment, the connection base point is a conventional counterweight mounting column configured to mount the clump weight, the clump weight integrally disposed on the connector is used as the clump weight shared by the first outer drum and the second outer drum, or an independent clump weight is mounted on the connector to serve as the clump weight shared by the first outer drum and the second outer drum.

In one embodiment, the first outer drum and the second outer drum are each provided with a connection base point fixedly mounted to the connector.

Preferably, the connection base point is in an irregular shape preventing the outer drum from rotating relative to the connector, for example, it is a dentiform or polygonal structure, or, the connection base point is a concave-convex base point disposed on the first outer drum and the second outer drum, and the connector is provided with a concave-convex connection portion matching with the concave-convex base point.

In the dual-drum washing machine of the present invention, the first outer drum and the second outer drum are connected as a whole with the connector, so as to effectively improve the compactness of the washing machine. The connector is fixedly mounted and connected by using the at least one connection base point on the first outer drum or the second outer drum so as to improve the stability thereof; moreover, the connector or the clump weight mounted on the connector is used as a shared counterweight of the first outer drum and the second outer drum. More specifically, after the two outer drums are connected as a whole, the damping effect is significant, and the working noise is reduced. By means of the above apparatus, the objective of the washing machine using the first outer drum and/or second outer drum to wash clothes is implemented, and meanwhile, the compactness of the washing machine is effectively improved, and the space is used rationally. The dual-drum washing machine of the present invention has a simple structure and significant effect, and is suitable for widespeard use.

In the present invention, at least one connection base point on the first outer drum or the second outer drum is used to fix the connector so that the two outer drums are connected as a whole, which, in the mounting process, can reduce the mounting distance between the two outer drums, thereby reducing the overall height of center of gravity of the two outer drums, and increasing the stability. Meanwhile, the occupation space inside the washing machine is reduced, the volume of the washing machine is relatively reduced, and the production cost and transportation cost are further reduced.

In another aspect of the present invention, a dual-drum washing machine includes: a washing machine frame, and a first outer drum and a second outer drum mounted in the frame, where the first outer drum is provided with a first clump weight, the second outer drum is provided with a second clump weight, and the first clump weight is connected to the second clump weight so that the first outer drum and the second outer drum are connected as a whole.

In one embodiment, the first clump weight is directly fixedly connected to the second clump weight.

In one embodiment, the first clump weight is connected to the second clump weight by welding, riveting or using a bolt.

In another embodiment, an alternative solution is that, the first clump weight and the second clump weight are connected as an integral structure with a connector, and the connector is respectively fixedly connected to the first clump weight and the second clump weight.

In one embodiment, the connector is connected to the first clump weight and the second clump weight by welding, riveting or by using a bolt.

In one embodiment, the first clump weight is connected to the second clump weight with at least one connector, and the connector is of a plate structure or a rod structure.

In one embodiment, the connector is an additional clump weight shared by the first outer drum and the second outer drum, or the connector is provided with an additional clump weight shared by the first outer drum and the second outer drum.

The connector may be a connection structure extending from the first clump weight or the second clump weight.

In another embodiment, in an alternative solution, the first clump weight and the second clump weight are of an integral structure.

In one embodiment, the first outer drum is located above the second outer drum, the first clump weight is mounted under the first outer drum, and the second clump weight is mounted above the second outer drum.

In one embodiment, the first clump weight is mounted under the front end portion of the first outer drum, and the second clump weight is mounted above the front end portion of the second outer drum.

In one embodiment, the first outer drum and/or second outer drum is further provided with an assistant clump weight.

In one embodiment, rear end portions of the first outer drum and the second outer drum are provided with rear connectors, and the rear end portions of the first outer drum and the second outer drum are connected with the rear connectors.

In the dual-drum washing machine of the present invention, the first outer drum and the second outer drum are connected by connecting the counter weights of the first outer drum and the second outer drum, thereby implementing integral connection of the two outer drums, so as to effectively improve the compactness of the washing machine; the structure is simple, and the assembling is convenient. More specifically, after the two outer drums are connected as a whole, the damping effect is significant, and the working noise is reduced. By means of the above apparatus, the objective of the washing machine using the first outer drum and/or second outer drum to wash clothes is implemented, and meanwhile, the compactness of the washing machine is effectively improved, and the space is used rationally. The dual-drum washing machine of the present invention has a simple structure and significant effect, and is suitable for widespeard use.

In the present invention, the counter weights on the first outer drum and the second outer drum are connected so that the two outer drums are connected as a whole, which relatively reduces the mounting distance between the two outer drums, thereby reducing the overall height of center of gravity of the two outer drums, and increasing the stability. Meanwhile, the occupation space inside the washing machine is reduced, the volume of the washing machine is relatively reduced, and the production cost and transportation cost are further reduced.

A dual-drum washing machine includes: a washing machine frame, and a first outer drum and a second outer drum mounted in the frame, where the first outer drum and the second outer drum are each provided with a drum; the first outer drum and the second outer drum are connected as a whole with a connector; and the first outer drum and the second outer drum are provided with a shared counter weight mechanism.

In one embodiment, the shared counter weight mechanism at least includes the connector.

In one embodiment, the connector is a shared clump weight, which also serves as the counter weight of the first outer drum and the second outer drum.

In one embodiment, the shared counter weight mechanism further includes a shared clump weight mounted on the connector. The connector connects the first outer drum and the second outer drum, so that the clump weight mounted on the connector serves as the shared counter weight of the first outer drum and the second outer drum.

In one embodiment, two ends of the connector are respectively fixedly connected to the front end portion of the first outer drum and the front end portion of the second outer drum in a detachable manner, and preferably, they are connected with a bolt.

In one embodiment, the connector is integrated with the front end portion of the first outer drum or the front end portion of the second outer drum, and has an end connected to the front end portion of the second outer drum or the front end portion of the first outer drum. The connector is integrated with the first outer drum or the second outer drum, and extends outwards from the front end portion of the first outer drum or the second outer drum, and an end of the extension is detachably connected to the front end portion of the other outer drum.

In one embodiment, the connector includes at least two sub-connectors, and each sub-connector is connected to the first outer drum and the second outer drum. The sub-connector may connect the front end portions of the first outer drum and the second outer drum, and may also connect the rear end portions of the first outer drum and the second outer drum, and may also connect intermediate portions of the first outer drum and the second outer drum. Preferably, the front and rear end portions of the first outer drum and the second outer drum are fixedly connected by using two sub-connectors. Therefore, the front and rear ends of the first outer drum and the second outer drum are fixedly connected, so as to form an integral structure.

In one embodiment, at least one sub-connector is connected to the front end portions of the first outer drum and the second outer drum, and the front end portions of the first outer drum and the second outer drum are connected with one or more sub-connectors. Preferably, a first sub-connector and a second sub-connector that are disposed at the front portion of the first outer drum and are symmetric about a line of centers of the two outer drums are respectively connected to the second outer drum. Another sub-connector may also be disposed between the first sub-connector and the second sub-connector, and preferably, the shared counter weight mechanism includes the sub-connector connecting the front end portions of the first outer drum and the second outer drum.

In one embodiment, at least one sub-connector is connected to the rear end portions of the first outer drum and the second outer drum, and preferably, the rear end portions of the first outer drum and the second outer drum are connected with one sub-connector.

In one embodiment, the connector includes at least two sub-connectors, where one sub-connector is connected to the first outer drum, the other sub-connector is connected to the second outer drum, and a shared counter weight mechanism or a part of the shared counter weight mechanism is disposed between the two sub-connectors. The first outer drum is connected to at least one sub-connector, the second outer drum is connected to at least one sub-connector, and the two sub-connectors are connected, so that the two sub-connectors serve as the shared counter weight mechanism of the first outer drum and the second outer drum; or the two sub-connector connected together are provided with clump weights, and the clump weights are used as the shared counter weight mechanism of the first outer drum and the second outer drum.

In one embodiment, at least one sub-connector is integrated with the first outer drum or the second outer drum.

In one embodiment, the front end portions and the rear end portions of the first outer drum and the second outer drum are connected with the same connector, the connector includes a front connector and a rear connector, the front connector is connected to the front end portions of the first outer drum and the second outer drum respectively, and the rear connector is connected to the rear end portions of the first outer drum and the second outer drum respectively.

In one embodiment, the connector further includes an intermediate portion connecting the front and rear connectors, the front connector, the rear connector and the intermediate portion are separated structures mounted by combination, or at least one end of the front, rear connector is integrated with the intermediate portion.

In one embodiment, the shared counter weight mechanism includes an assistant clump weight mounted on the first outer drum and/or second outer drum. To implement balancing of the first outer drum and the second outer drum, an assistant clump weight is disposed on the first outer drum or/and the second outer drum, and the assistant clump weight matches with the connector to balance the first outer drum and the second outer drum.

In the dual-drum washing machine of the present invention, the first outer drum and the second outer drum are connected as a whole with the connector, so as to effectively improve the compactness of the washing machine. The connector or the clump weight mounted on the connector is used as the shared counter weight of the first outer drum and the second outer drum. More specifically, after the two outer drums are connected as a whole, the damping effect is significant, and the working noise is reduced. By means of the above apparatus, the objective of the washing machine using the first outer drum and/or second outer drum to wash clothes is implemented, and meanwhile, the compactness of the washing machine is effectively improved, and the space is used rationally. The dual-drum washing machine of the present invention has a simple structure and significant effect, and is suitable for widespeard use.

Figure 1:
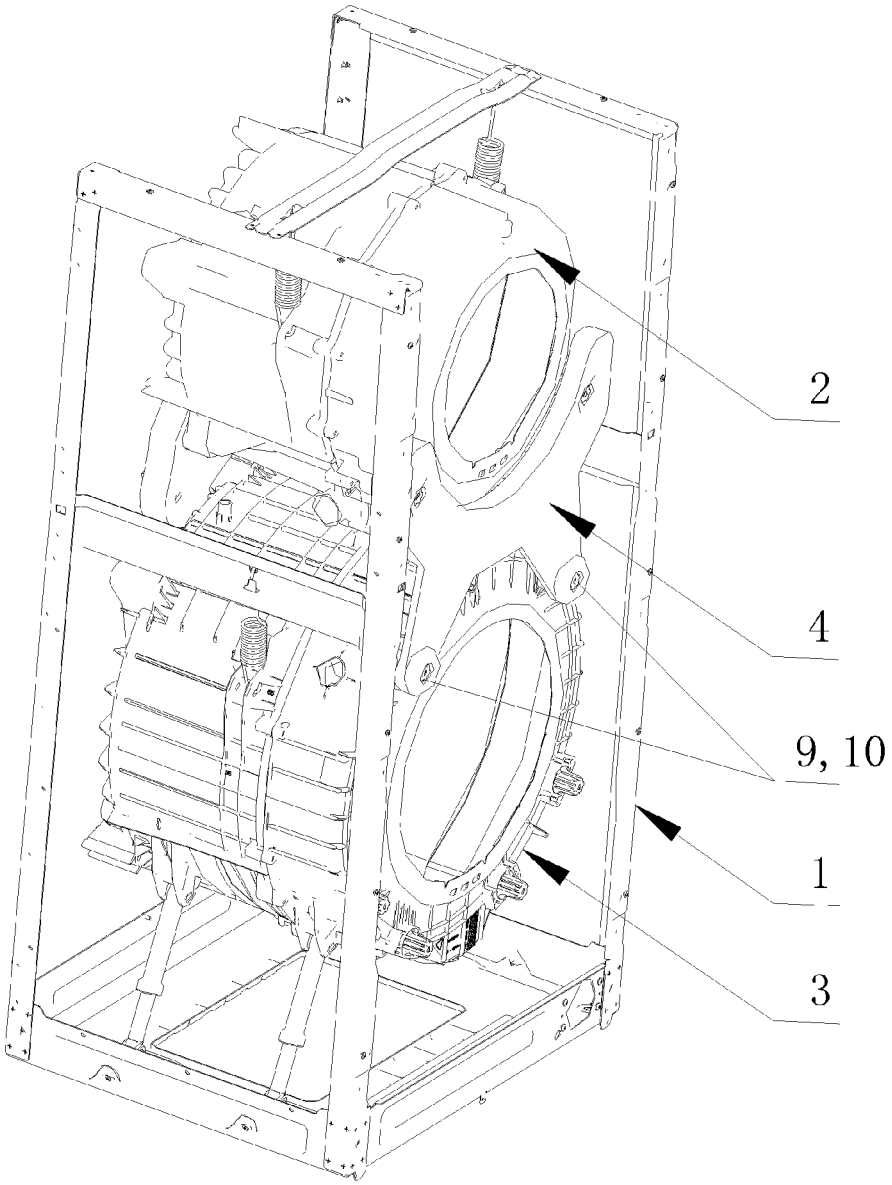
FIG. 1 is a schematic structural diagram of a dual-drum washing machine according to one embodiment of the present invention.

A list of reference numerals used herein the disclosure is as follows: 1, a frame; 2, a first outer drum; 3, a second outer drum; 4, a connector; 5, a spring; 6, a damper; 7, a clump weight; 8, a assistant clump weight; 9, a connection base point; 10, a counterweight mounting column; 11, a vertical beam; 12, a upper cross beam; 13, a middle cross beam; 14, a lower cross beam; 41, a first sub, a connector; 42, a second sub, a connector; 43, a front connector; 44, a rear connector; 45, a intermediate portion; 46, a U-shaped limiting junction; 47, a bolt; 48, a limiting end; 70, a shared clump weight; 71, a first clump weight; 72, a second clump weight; 73, a first upper mounting hole; 74, a first lower mounting hole; 75, a second upper mounting hole; 76, a second lower mounting hole; 92 and 94, a left connection base point; 93 and 95, a right connection base point; 102 and 104, a left counterweight mounting column; 103 and 105, a right counterweight mounting column.

DETAILED DESCRIPTION OF THE INVENTION

Specific embodiments of the present invention are further described in detail hereinafter with reference to the accompanying drawings.

As shown in FIGS. 1-15, a dual-drum washing machine of the present invention includes: a washing machine frame 1, a first outer drum 2 and a second outer drum 3 mounted in the frame 1, the first outer drum 2 and the second outer drum 3 being each provided with a drum, where the first outer drum 2 and the second outer drum 3 are disposed in a vertical direction, the first outer drum 2 and the second outer drum 3 are connected as a whole with a connector 4, the first outer drum 2 or the second outer drum 3 is provided with a connection base point 9 fixedly mounted to the connector 4, and the connection base point 9 is formed by a counterweight mounting column 10 integrally disposed on the first outer drum 2 and the second outer drum 3. The connector 4 is fixedly connected to the counterweight mounting column 10 on the first outer drum 2 and/or the second outer drum 3.

The first outer drum 2 and the second outer drum 3 are provided with a shared counter weight mechanism. The first outer drum 2 is provided with a first clump weight 71, and the second outer drum 3 is provided with a second clump weight 72; the first clump weight 71 is mounted under the front end portion of the first outer drum 2, and the second clump weight 74 is mounted above the front end portion of the second outer drum 3; the first clump weight 71 is connected to the second clump weight 72, to preferably form the connector 4, so that the first outer drum 2 and the second outer drum 3 are connected as a whole.

Figure 2:
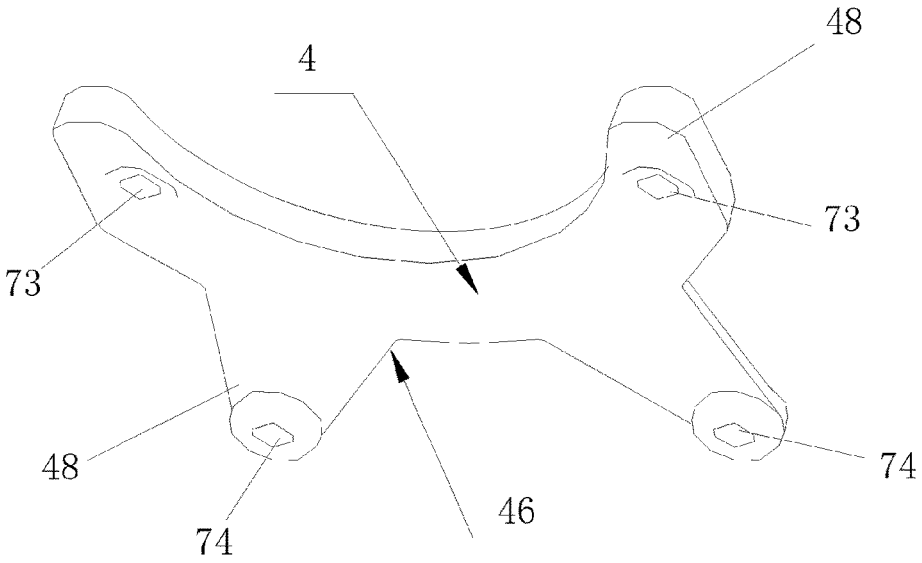
FIG. 2 is a schematic structural diagram of a connector according to one embodiment of the present invention.
Figure 3:
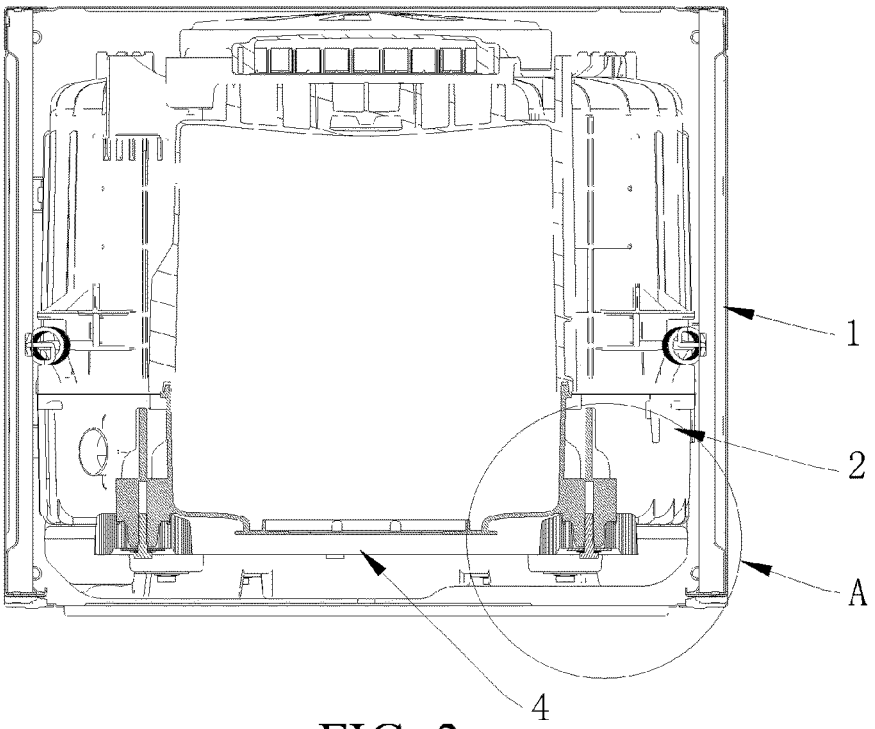
FIG. 3 is a schematic mounting diagram of a connector according to one embodiment of the present invention.
Figure 4:
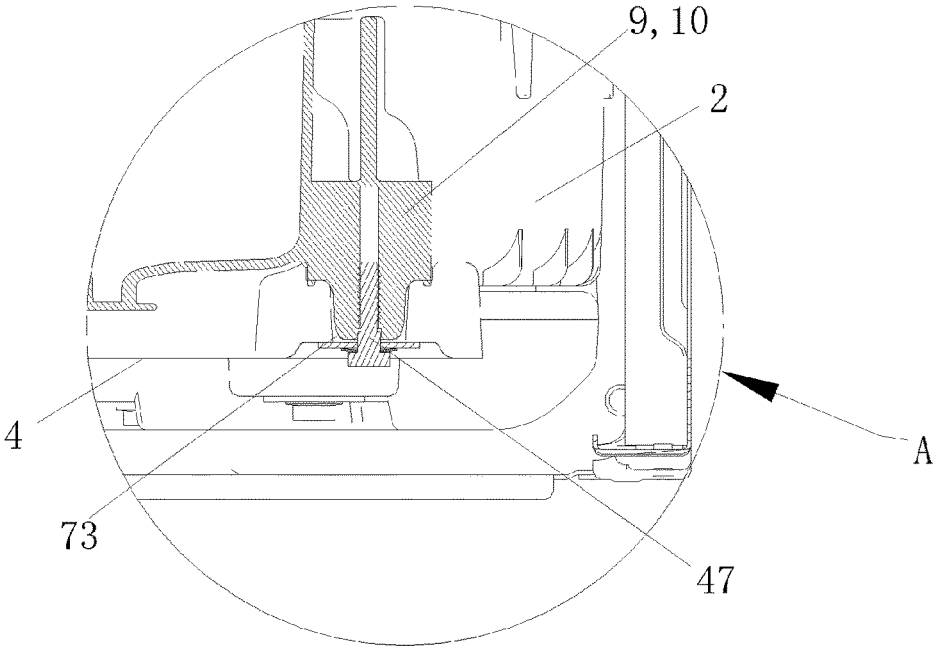
FIG. 4 is a schematic enlarged diagram of area A in FIG. 3 according to one embodiment of the present invention.

As shown in FIGS. 1-3, a dual-drum washing machine includes: a first outer drum 2 and a second outer drum 3 mounted in a washing machine frame 1; the first outer drum 2 and the second outer drum 3 are connected with a connector 4 to form an integral structure; the first outer drum 2 and the second outer drum 3 that are connected together are connected to the frame 1 with a shared damping apparatus; the damping apparatus includes a first damping device of the first outer drum 2 connected to the frame 1, a second damping device of the second outer drum 3 connected to the frame 1, and a third damping device of the first outer drum 2 or the second outer drum 3 connected to a middle cross beam 13 disposed on the frame 1. By means of the above disposition, the first outer drum 2 and the second outer drum 3 that are connected are disposed on the frame 1 with the shared damping apparatus, thereby achieving the objective that the two drums share one damping apparatus.

As shown in FIGS. 16-19, in this embodiment, the frame 1 includes four vertical beams 11 forming four lateral edges of the frame 1, and an upper cross beam 12, a middle cross beam 13 and a lower cross beam 14 that are connected to the vertical beams 11 and distributed from top to bottom. Upper ends of the adjacently disposed vertical beams 11 are respectively connected to two ends of the upper cross beam 12, and lower ends of the adjacently disposed vertical beams 11 are respectively connected to two ends of the lower cross beam 14. The middle cross beam 13 is disposed horizontally between the upper cross beam 12 and the lower cross beam 14, and middle portions of the adjacently disposed vertical beam 11 are respectively connected to two ends of the middle cross beam 13. Therefore, the stability and firmness of the frame 1 are improved.

Figure 19:
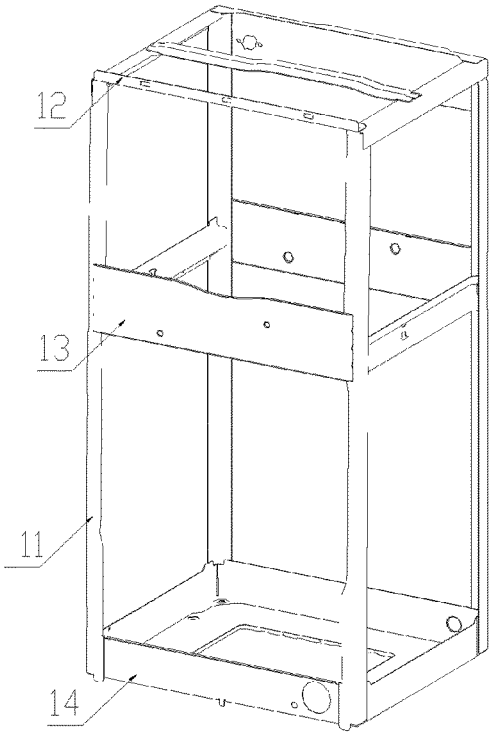
FIG. 19 is a schematic structural diagram of a frame according to one embodiment of the present invention.

As shown in FIG. 19, in this embodiment, two ends of the upper cross beam 12, the middle cross beam 13 and the lower cross beam 14 are respectively connected to upper, middle and lower portions of the adjacent vertical beams 11, thereby forming the frame 1 of the washing machine.

Embodiment 1

As shown in FIGS. 1-4, in this embodiment, the first outer drum 2 and the second outer drum 3 are each provided with a connection base point 9 fixedly mounted to the connector 4, and the connection base point 9 is a counterweight mounting column 10 protruding from the surface of the outer drum. In this embodiment, front ends of the first outer drum 2 and the second outer drum 3 are each provided with two counterweight mounting columns 10 fixedly mounted to the connector 4. Upper and lower ends of the connector 4 are U-shaped limiting junctions 46 respectively matching with profiles of the first outer drum 2 and the second outer drum 3; the whole connector 4 is H-shaped or the X-shaped, and has an upper end matching with a lower profile of the front end of the first outer drum 2, and a lower end matching with an upper profile of the front end of the second outer drum 3. Two limiting ends 48 of the U-shaped limiting junction are each provided with a mounting hole connected to the counterweight mounting column 10 of the first outer drum 2 or the second outer drum 3.

Specifically, two limiting ends 48 of the U-shaped limiting junction corresponding to the front end of the first outer drum 2 are each provided with a first upper mounting hole 73, and end portions of two limiting ends 48 at the lower end of the connector 4 are provided with a first lower mounting hole 74 connected to the second outer drum 3.

The front ends of first outer drum 2 and the second outer drum 3 are provided with the counterweight mounting columns 10 protruding from the surfaces of the outer drums, the connector 4 is connected to the counterweight mounting columns 10 respectively with the first upper mounting hole 73 and the first lower mounting hole 74, and is secured with a bolt 47, so as to connect the first outer drum 2 and the second outer drum 3 as a whole.

Embodiment 2

Figure 5:
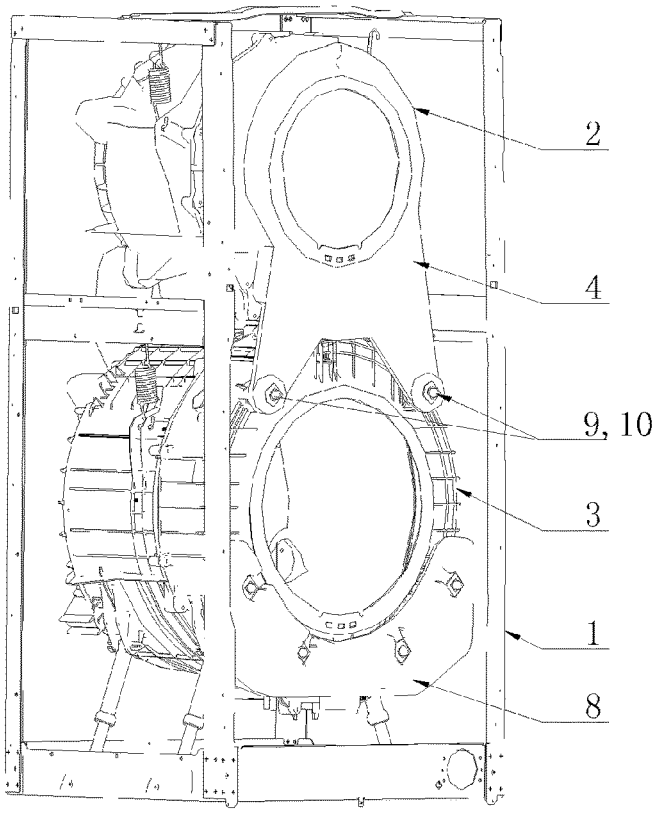
FIG. 5 is a schematic structural diagram of integrating a connector and a first outer drum according to one embodiment of the present invention.
Figure 6:
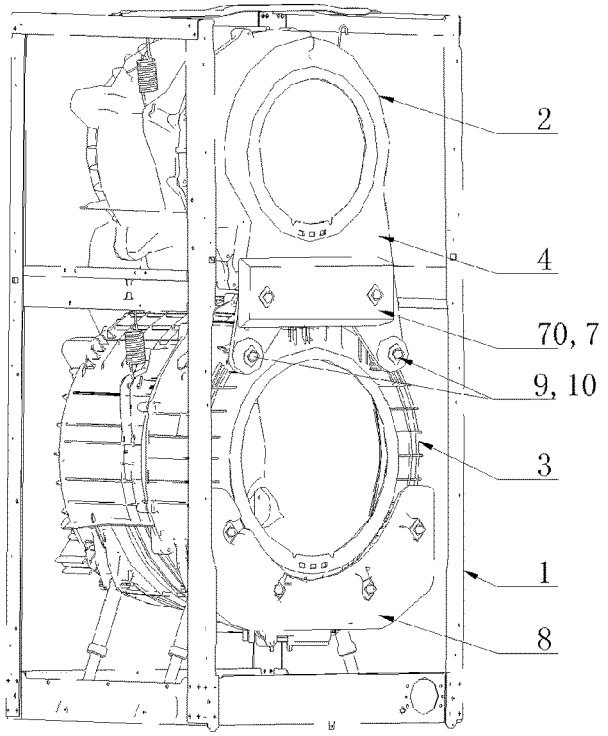
FIG. 6 is a schematic structural diagram of mounting a clump weight on the first outer drum of FIG. 5 according to one embodiment of the present invention.

As shown in FIGS. 5 and 6, a difference between this embodiment and Embodiment 1 lies in that, the connector 4 is integrated with the front end portion of the first outer drum 2, and an end thereof is connected to the front end portion of the second outer drum 3.

The connector 4 extends outwards from the lower portion of the front end of the first outer drum 2, and the end is connected to the upper portion of the front end of the second outer drum 3 disposed at the lower portion. A connection base point 9 is disposed on the front end of the second outer drum 3 and has a profile protruding from the surface of the outer drum, and the connection base point 9 is a counterweight mounting column 10 protruding from the surface of the outer drum, so that the second outer drum 3 is connected by the connector 4 integrated with the first outer drum 2, and therefore, the first outer drum and the second outer drum are integrated.

Embodiment 3

A difference between this embodiment and Embodiment 1 and Embodiment 2 lines in that, the first outer drum is provided with a counterweight mounting column fixedly mounted to the connector, the second outer drum is provided with two connection base points fixedly mounted to the connector, and the connection base points are connected by the counterweight mounting column (not shown). The design is symmetric along a plane where an axis of the first outer drum or the second outer drum is located, so that the center of gravity is more stable.

Embodiment 4

Figure 7:
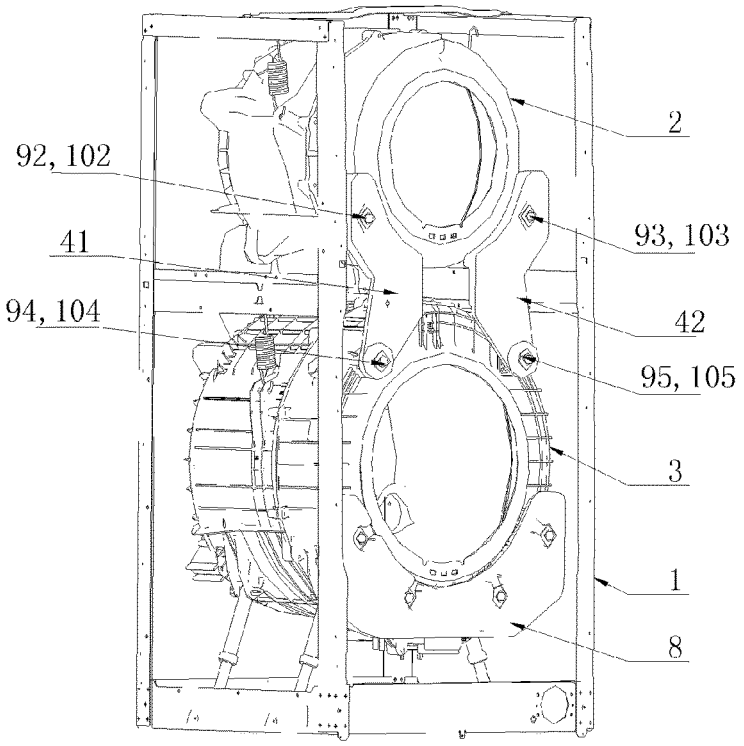
FIG. 7 is a schematic structural diagram of the present invention provided with a first sub-connector and a second sub-connector.
Figure 8:
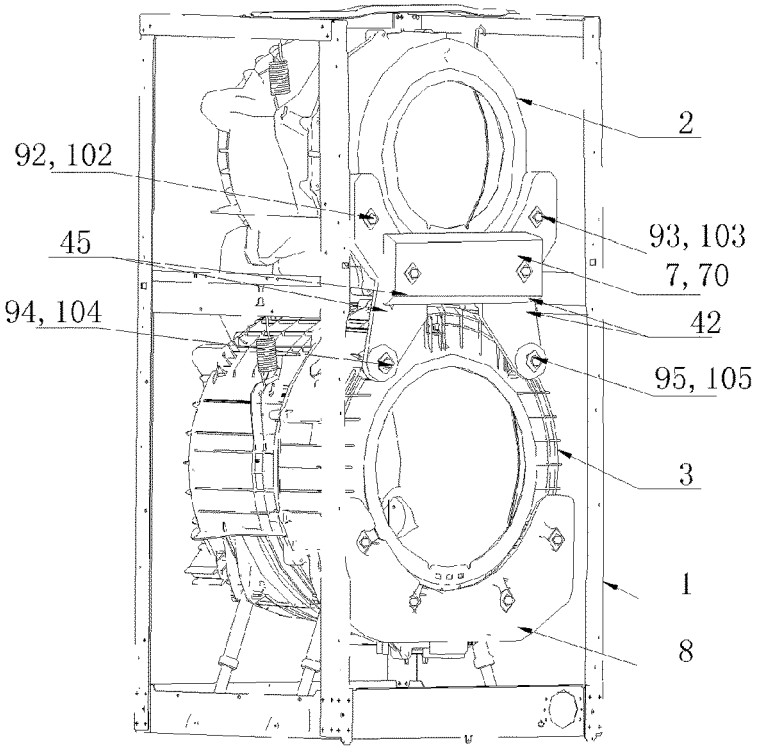
FIG. 8 is a schematic structural diagram of mounting clump weights on the first sub-connector and the second sub-connector of FIG. 7 according to one embodiment of the present invention.

As shown in FIGS. 7 and 8, in this embodiment, the connector 4 includes a first sub-connector 41 and a second sub-connector 42, and the first sub-connector 41 and the second sub-connector 42 are respectively connected to the front end of the first outer drum 2 and the front end of the second outer drum 3. The first sub-connector 41 and the second sub-connector 42 are disposed symmetrically about a plane where a line of axes of the first outer drum 2 and the second outer drum 3 is located.

The front end of the first outer drum 2 is symmetrically provided with a left connection base point 92 formed by a left counterweight mounting column 102 and a right connection base point 93 formed by a right counterweight mounting column 103, and the front end of the second outer drum 3 is symmetrically provided with a left connection base point 94 formed by a left counterweight mounting column 104 and a right connection base point 95 formed by a right counterweight mounting column 105. One end of the first sub-connector 41 is fixedly connected to the left counterweight mounting column 102 of the first outer drum 2, and the other end is fixedly connected to the left counterweight mounting column 104 of the second outer drum 3. One end of the second sub-connector 42 is fixedly connected to the right counterweight mounting column 103 of the first outer drum 2, and the other end is fixedly connected to the right counterweight mounting column 105 of the second outer drum 3. Preferably, the first sub-connector 41 and the second sub-connector 42 are disposed symmetrically.

Embodiment 5

As shown in FIGS. 1-4, in this embodiment, the connector 4 is a clump weight 70 shared by the first outer drum 2 and the second outer drum 3, and the first outer drum 2 and the second outer drum 3 are not provided with any counter weight structure.

Embodiment 6

A difference between this embodiment and Embodiment 5 lies in that, the connector 4 is provided with a clump weight 70 shared by the first outer drum 2 and the second outer drum 3, the clump weight 70 is fixedly connected in a detachable manner, and the shared clump weight 70 is fixed to the connector 4 with a bolt (referring to FIG. 6 and FIG. 8).

Embodiment 7

As shown in FIG. 7, in this embodiment, the first sub-connector 41 and the second sub-connector 42 are a clump weight 70 shared by the first outer drum 2 and the second outer drum 3.

Embodiment 8

A difference between this embodiment and Embodiment 7 lies in that, as shown in FIG. 8, the first sub-connector 41 and the second sub-connector 42 are provided with a shared clump weight 70. Two end portions of the clump weight 7 are mounted to the first sub-connector 41 and the second connector 42 respectively with a bolt 47. Therefore, the first outer drum 2, the first sub-connector 41, the second sub-connector 42, the clump weight 7 and the connector 4 are used as counter weights of the second outer drum; and the second outer drum 3, the first sub-connector 41, the second sub-connector 42, the clump weight 7 and the connector 4 are used as counter weights of the first outer drum 2.

Embodiment 9

Figure 9:
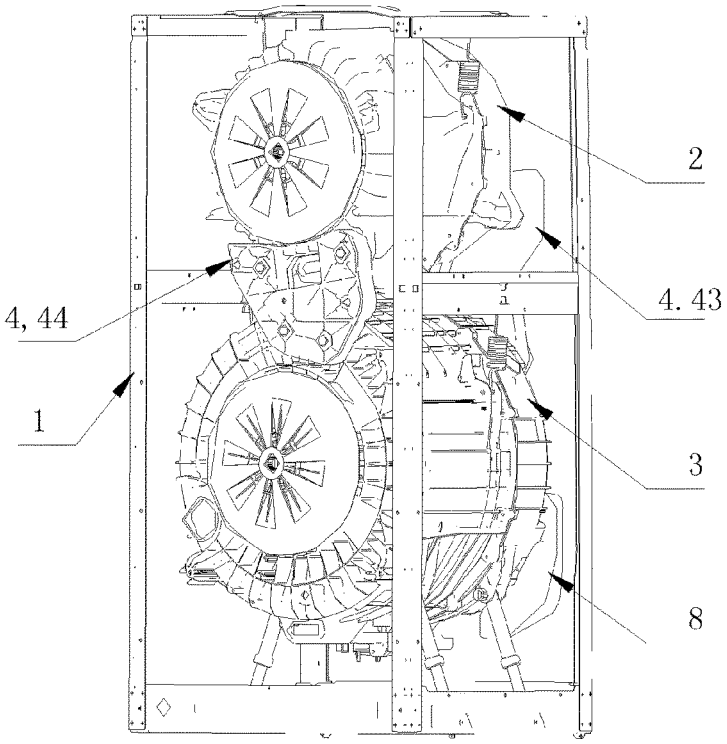
FIG. 9 is a schematic structural diagram of connection with a rear connector according to one embodiment of the present invention.
Figure 10:
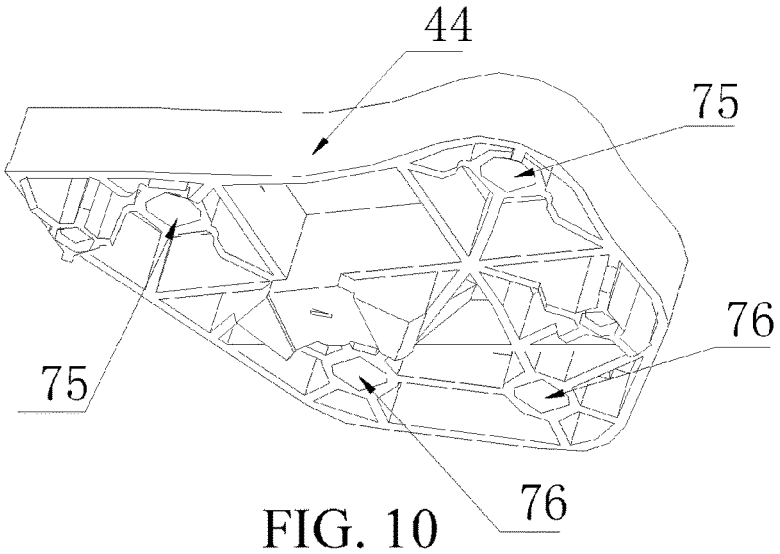
FIG. 10 is a schematic structural diagram of a rear connector according to one embodiment of the present invention.
Figure 11:
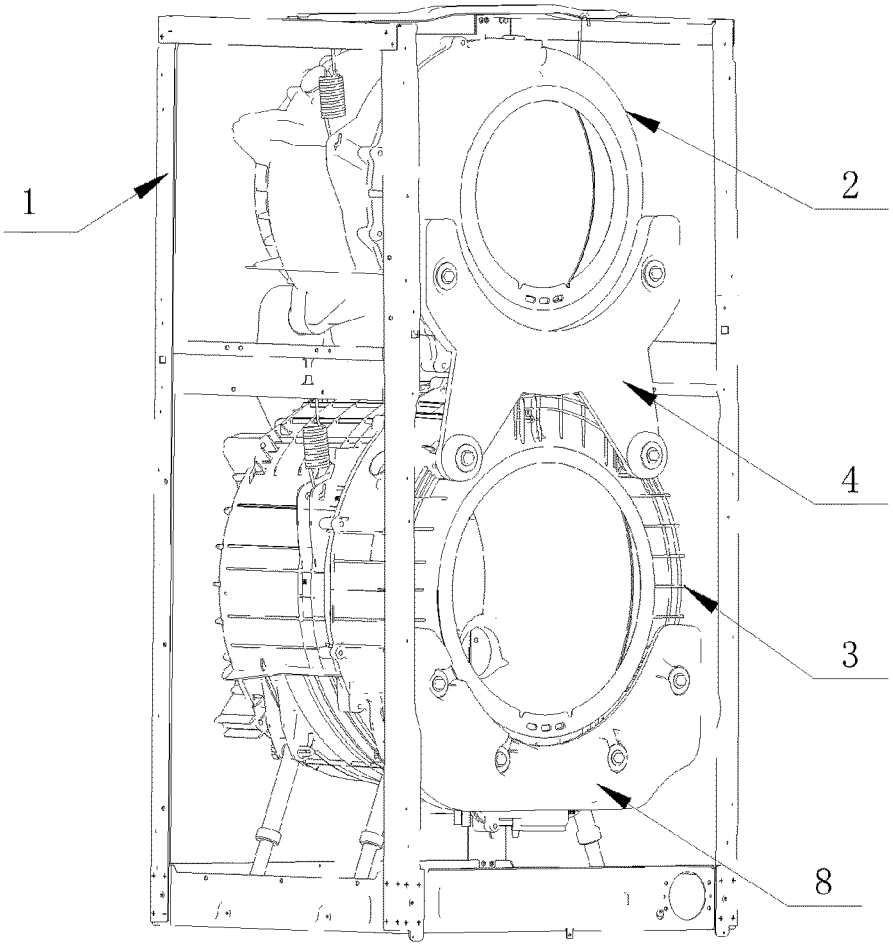
FIG. 11 is a schematic structural diagram of disposing an assistant clump weight according to one embodiment of the present invention.

As shown in FIGS. 9 and 10, in this embodiment, the connector includes a front connector 43 that connects front end portions of the first outer drum 2 and the second outer drum 3; and a rear connector 44 that connects rear end portions of the first outer drum 2 and the second outer drum 3.

In this embodiment, the rear connector 44 and the front connector 43 match with each other, so that the front and rear ends of the first outer drum 2 and the second outer drum 3 are fixedly connected in a detachable manner; therefore, mass distribution of the first outer drum 2 and the second outer drum 3 is more uniform, and mounting of the first outer drum 2 and the second outer drum 3 is more stable.

Two ends at the upper side of the rear connector 44 are each provided with a second upper mounting hole 75, and two ends at the lower side of the rear connector 44 are each provided with a second lower mounting hole 76. Therefore, by means of the second upper mounting hole 75 or the second lower mounting hole 76, the rear connector 44 is detachably connected to the first outer drum 2 or the second outer drum 3 through the bolt 47, thereby implementing the stable connection of the first outer drum 2 and the second outer drum 3.

Embodiment 10

This embodiment is on the basis of Embodiment 9, and the front connector 43 and/or the rear connector 44 may further be formed by an integral member having a certain weight, so as to adjust the counter weights at the front and rear ends of the first outer drum 2 and the second outer drum 3, and together serve as a shared counter weight mechanism of the first outer drum 2 and the second outer drum 3, thereby providing balance adjustment.

Alternatively, only the front connector 43 is integrally provided with a clump weight 70 shared by the first outer drum 2 and the second outer drum 3, and the rear connector 44 merely functions to connect the first outer drum 2 to the second outer drum 3.

Embodiment 11

This embodiment is on the basis of Embodiment 9, and the front connector 43 has a clump weight 70 shared by the first outer drum 2 and the second outer drum 3 fixedly connected thereon in a detachable manner, and the clump weight 7 is fixed on the front connector 43 with the bolt 47 (referring to Embodiment 6).

Embodiment 12

A difference between this embodiment and Embodiment 9 lies in that, the front connector 43 and/or the rear connector 44 may also be disposed as a structure integrated with the first outer drum 2 or the second outer drum 3 (referring to Embodiment 2).

Embodiment 13

As shown in FIGS. 5-8 and 11, in this embodiment, an assistant clump weight 8 configured to adjust balance is disposed on the lower profile at the front end of the second outer drum 3 of the washing machine, the assistant clump weight 8 is also mounted on the counterweight mounting column 10, and a mounting manner is the same as that of the conventional structure. By disposing the assistant clump weight 8 on the second outer drum 3, the first outer drum 2 and the second outer drum 3 reach adjusted balance respectively by mans of the second outer drum 3, the connector 4 and the assistant clump weight 8 and by means of the first outer drum 2, the connector 4 and the assistant clump weight 8, so as to achieve the working effect that inner drums respectively disposed on the first outer drum 2 and the second outer drum 3 smoothly rotate about the axes. Preferably, the first outer drum 2 and the second outer drum 3 are disposed in a vertical direction, and the connector 4 connects the first outer drum 2 disposed at the upper portion to the second outer drum 3 disposed at the lower portion, and therefore, the connector 4 and/or the shared clump weight 70, and the assistant clump weight 8 mounted on the second outer drum 3 form the shared counter weight mechanism of the first outer drum 2 and the second outer drum 3.

Embodiment 14

A difference between this embodiment and Embodiment 13 lies in that, the assistant clump weight is disposed on the first outer drum, or is disposed both on the first outer drum and the second outer drum (not shown).

Embodiment 15

Figure 12:
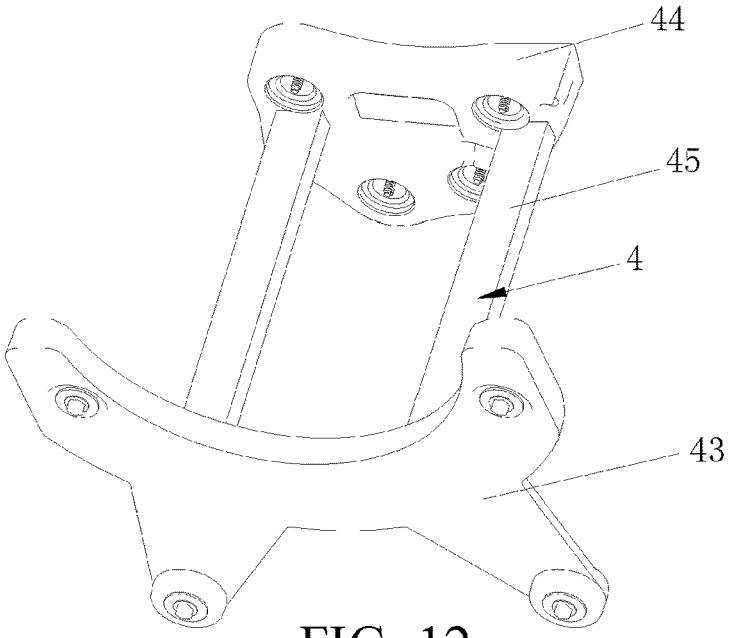
FIG. 12 is another schematic structural diagram of a connector according to one embodiment of the present invention.
Figure 13:
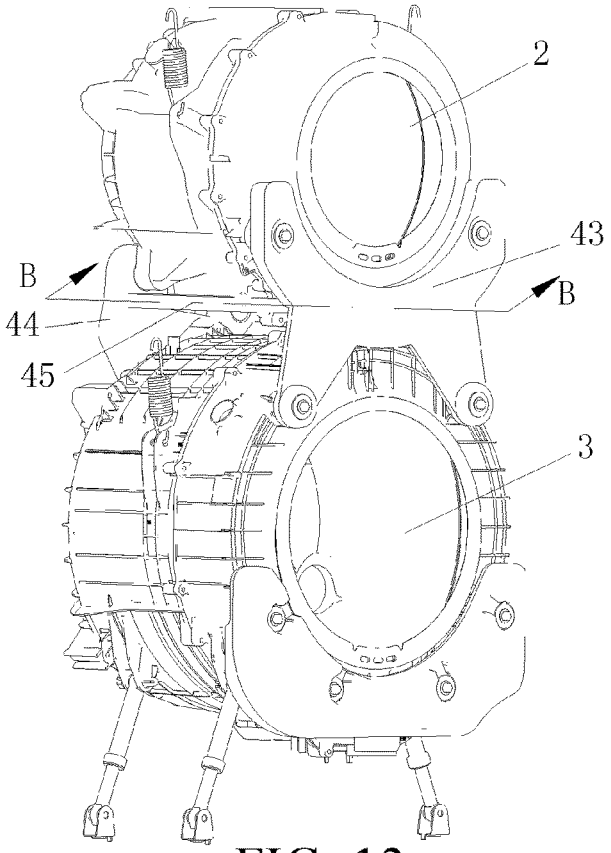
FIG. 13 is another schematic structural mounting diagram of a connector according to one embodiment of the present invention.
Figure 14:
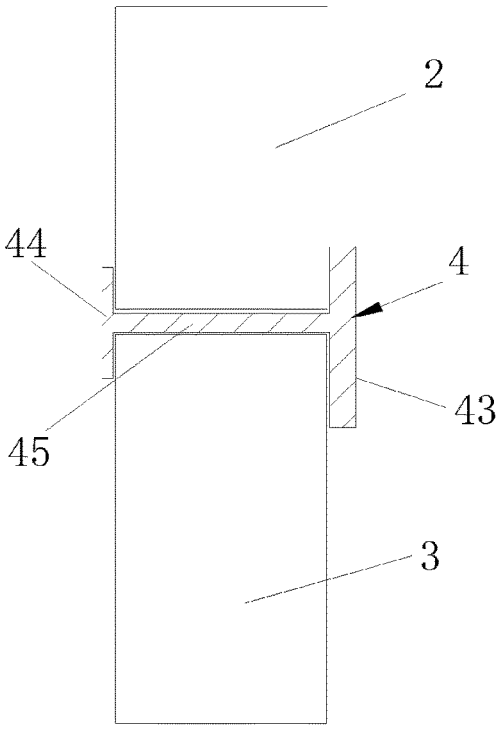
FIG. 14 is a sectional diagram along line B-B of FIG. 13.

As shown in FIGS. 12-14, in this embodiment, the connector 4 includes a front connector 43 and a rear connector 44, the front connector 43 is respectively connected to the front end portions of the first outer drum 2 and the second outer drum 3, and the rear connector 44 is respectively connected to the rear end portions of the first outer drum 2 and the second outer drum 3.

As shown in FIG. 12, the front connector 43 and the rear connector 44 are connected as a whole with an intermediate portion 45. A cross section of the connector 4 along an axis of the outer drum vertically assumes an H-shaped structure. The front connector 43, the rear connector 44 and the intermediate portion 45 are separated structures mounted by combination, or, at least one end of the front connector 43 and rear connector 44 is integrated with the intermediate portion 45. Preferably, the three are of an integral structure. The structures of the front connector 43 and the rear connector 44 may be obtained with reference to Embodiment 9.

Embodiment 16

This embodiment is a combination of Embodiment 15 and Embodiment 4, that is, the connector, the rear connector and the intermediate portion in Embodiment 15 each include two parts including left and right, and are disposed symmetrically with respect to the plane where the line of axes of the first outer drum and the second outer drum is located (not shown).

Embodiment 17

Figure 15:
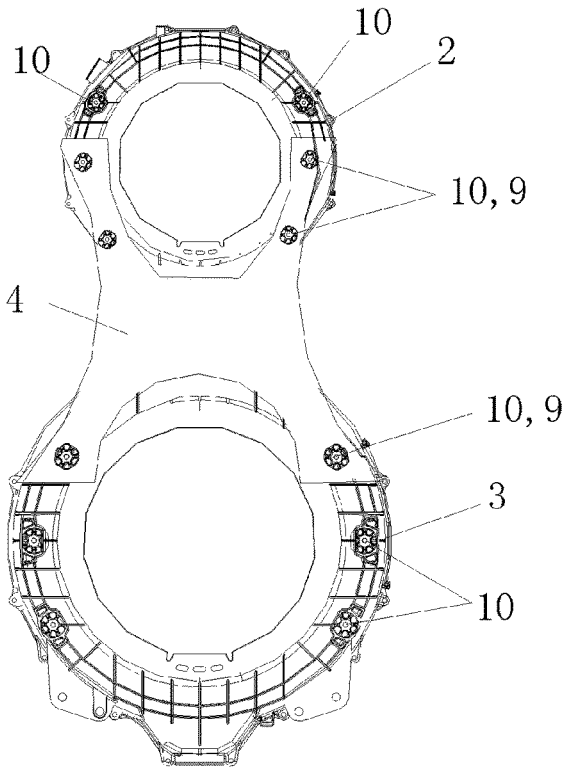
FIG. 15 is another schematic mounting diagram of a connector according to one embodiment of the present invention.

The connector in the above structures is not limited to be mounted and connected by using the counterweight mounting columns at the lower portion of the front end of the first outer drum and at the upper portion of the front end of the second outer drum. As shown in FIG. 15, counterweight mounting columns 10 are disposed at left and right sides of the first outer drum 2 and the second outer drum 3, the connector 4 has upper and lower ends extended relative to the above connector structures, and is mounted and connected by using the counterweight mounting columns 10 disposed at the left and right sides of the outer drums. In the drawing, the first outer drum 2 tilts upwards, the second outer drum 3 tilts downwards, and they are provided with the counterweight mounting columns 10. Upper and lower ends of the connector 4 may further extend to be fixedly connected to the counterweight mounting columns 10.

The first outer drum and the second outer drum are not limited to be disposed in a vertical direction, and they may also be disposed in a horizontal direction, or in an inclined direction.

Embodiment 18

As shown in FIG. 15, in this embodiment, the first outer drum 2 is provided with four connection base points 9 fixedly connected to the connector 4, and the second outer drum 3 is provided with two connection base points 9 fixedly connected to the connector 4. The numbers of the connection base points 9 are not limited to the above numbers. For example, first outer drum 2 tilts upwards, the second outer drum 3 tilts downwards, and they are provided with connection base points 9. The upper and lower ends of the connector 4 may further extend to be fixedly connected to the counterweight mounting column 50.

The first outer drum 2 and the second outer drum 3 of the present invention are not limited to be disposed in a vertical direction, and they may also be disposed in a horizontal direction, or in an inclined direction.

Embodiment 19

Figure 28:
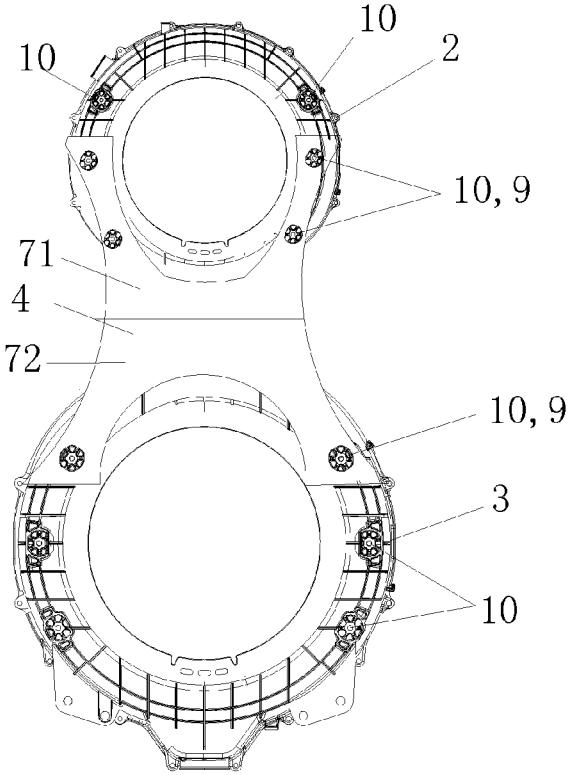
FIG. 28 is a schematic structural diagram of vertically integrating a first counter weight and a second counter weight according to one embodiment of the present invention.

As shown in FIG. 28, in this embodiment, the first clump weight 71 and the second clump weight 72 are an integral structure forming the connector 4.

Embodiment 20

Figure 24:
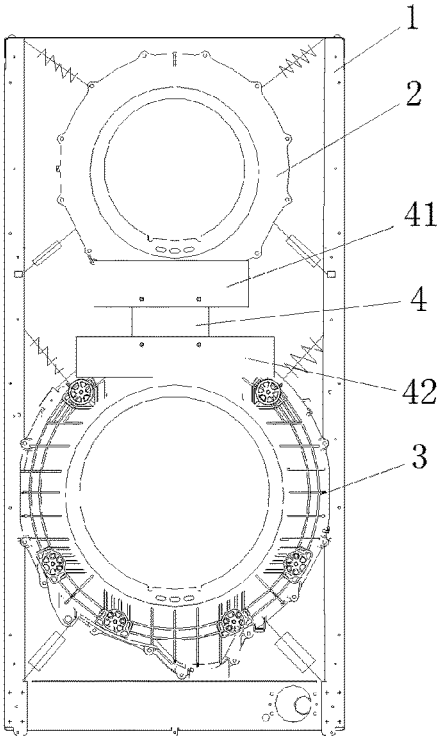
FIG. 24 is a schematic structural diagram of connecting a first counter weight and a second counter weight with a connector according to one embodiment of the present invention.
Figure 25:
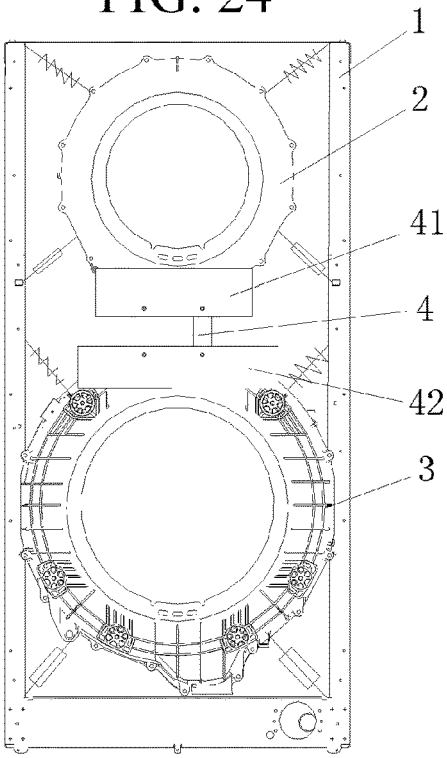
FIG. 25 is a schematic structural diagram of connecting a first counter weight and a second counter weight with another connector according to one embodiment of the present invention.

As shown in FIGS. 24 and 25, in this embodiment, the first clump weight 71 and the second clump weight 72 are connected into an integral structure with the connector 4, and the connector 4 is respectively fixedly connected to the first clump weight 71 and the second clump weight 72 with a bolt.

As shown in FIG. 24, the connector 4 is of a plate structure, and the first clump weight 71 and the second clump weight 72 are connected with one connector 4. As shown in FIG. 25, the connector 4 is of a rod structure, and two groups of rod-shaped connectors 4 are used to connect the first clump weight 71 and the second clump weight 72.

Embodiment 21

Figure 26:
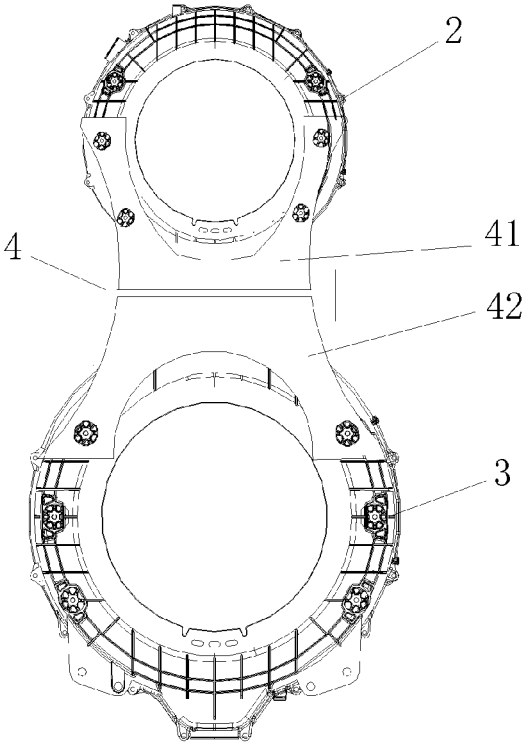
FIG. 26 is a schematic structural diagram of connecting a first counter weight and a second counter weight with still another connector according to one embodiment of the present invention.

This embodiment has further improvements on the basis on Embodiment 20: for ease of assembling, the weights of the first clump weight 71 and the second clump weight 72 may be reduced, and the connector 4 is made as an additional clump weight shared by the first outer drum 2 and the second outer drum 3 (referring to FIG. 26), or the connector 4 is provided with an additional clump weight shared by the first outer drum and the second outer drum (not shown).

Embodiment 22

Figure 27:
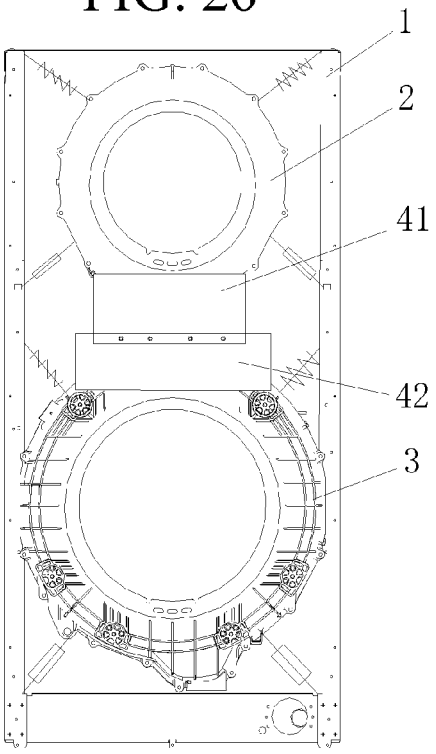
FIG. 27 is a schematic structural diagram of directly connecting a first counter weight and a second counter weight according to one embodiment of the present invention.

As shown in FIG. 27, in this embodiment, the first clump weight 71 and the second clump weight 72 are independently mounted on the first outer drum 2 and the second outer drum 3, and the first clump weight 71 is directly fixedly connected to the second clump weight 72.

In Embodiment 20 to Embodiment 22, the connector 4 is respectively connected to the first clump weight 71 and the second clump weight 72 by welding or riveting to replace the bolt connection.

Embodiment 23

Figure 20:
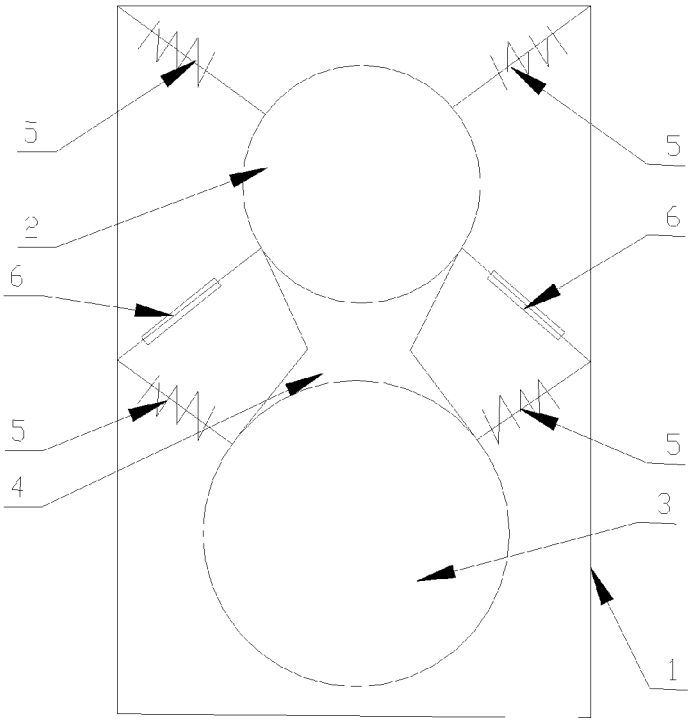
FIG. 20 is a schematic mounting diagram according to Embodiment 23 of the present invention.

As shown in FIG. 20, in this embodiment, the damping apparatus includes that, the first damping device is a spring 5 connected to the upper portion of the first outer drum 2, and the spring 5 is connected to the upper cross beam 13 disposed on the frame 1. The second damping device is a spring 5 connected to the upper portion of the second outer drum 3, and the spring 5 is connected to the middle cross beam 14 disposed on the frame 1. The third damping device is a damper 6 connected to the lower portion of the first outer drum, and the damper 6 is connected to the middle cross beam 14 of the frame 1. In the present invention, the springs 5 are configured to hang the outer drums, and damper 6 is configured to damp and support the outer drums, and such structure is a conventional structure.

Figure 16:
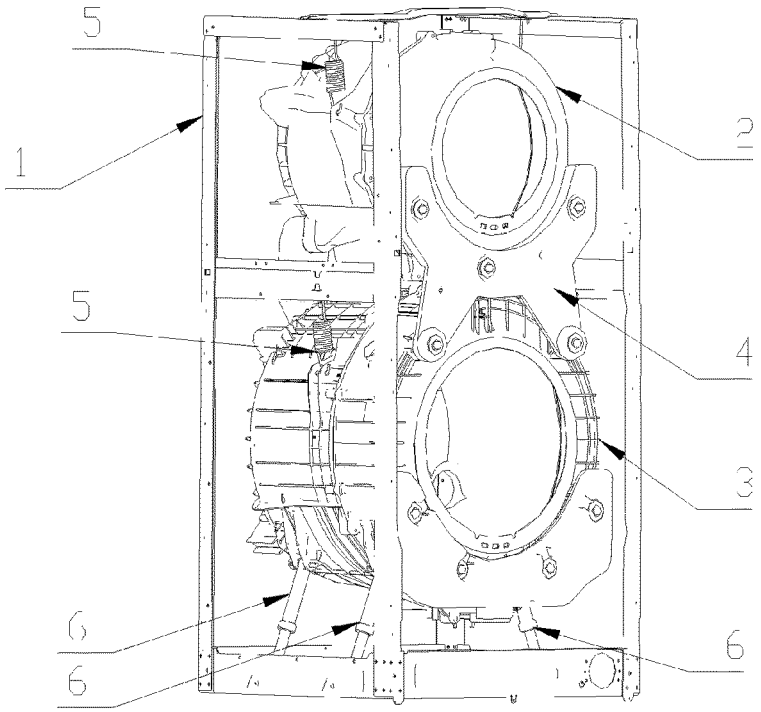
FIG. 16 is a schematic structural diagram of a dual-drum washing machine according to one embodiment of the present invention.
Figure 17:
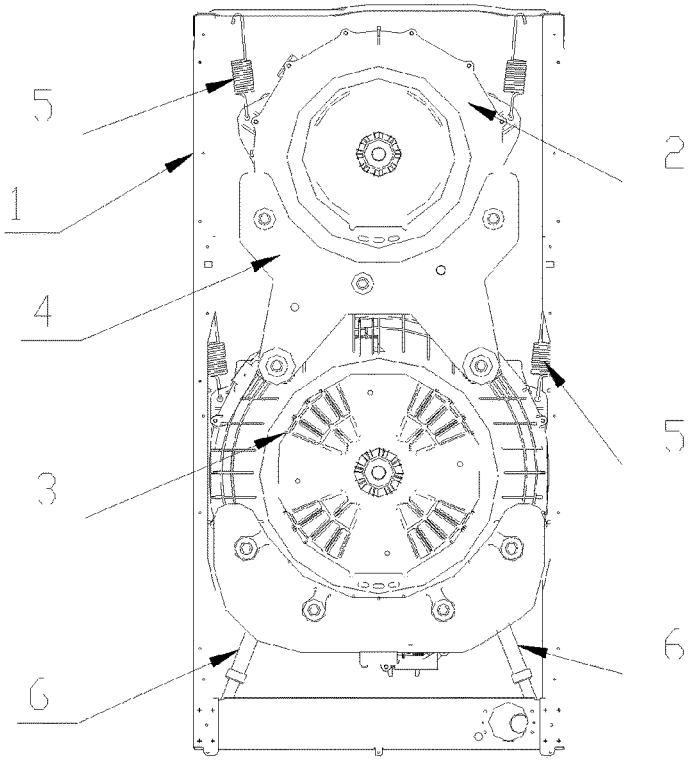
FIG. 17 is a front view of a dual-drum washing machine according to one embodiment of the present invention.
Figure 18:
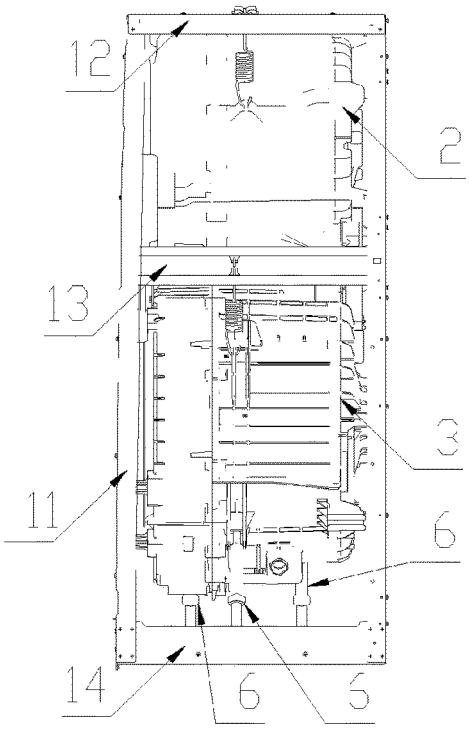
FIG. 18 is a side view of a dual-drum washing machine according to one embodiment of the present invention.

As shown in FIGS. 16-18, in this embodiment, two symmetric sides at the upper portion of the first outer drum 2 are connected to the frame 1 respectively by a spring 5; two symmetric sides at the upper portion of the second outer drum 3 are connected to the frame 1 respectively by a spring 5. The springs 5 on the first outer drum 2 and the second outer drum 3 are both disposed symmetrically with respect to the plane where the axes of the first outer drum 2 and the second outer drum 3 are located.

In this embodiment, an intersection of the axes of the two symmetrically disposed springs 5 is located on the plane where the axes of the first outer drum 2 and the second outer drum 3 are located, and meanwhile, the axes of the springs 5 are each disposed on a center of gravity cross section of the first outer drum 2 and the second outer drum 3. Therefore, the supporting of the springs 5 on the first outer drum 2 and the second outer drum 3 is more stable. In this embodiment, preferably, angles formed by the two symmetric springs 5 and the vertical beam 11 are both set to the same angle value between 30 degrees to 70 degrees.

In this embodiment, the upper portion of the second outer drum 3 is mounted to the middle cross beam 13 disposed on the upper portion of the second outer drum 3 respectively by using the springs 5 symmetrically disposed at two sides. Therefore, the second outer drum 3 may be fixedly disposed in the frame 1 by the spring 5 disposed at the middle position. Likewise, the upper portion of the first outer drum 2 is mounted to the upper cross beam 12 disposed on the upper portion of the first outer drum 2 respectively by using the springs 5 symmetrically disposed at two sides.

In this embodiment, the first outer drum 2 or the second outer drum 3 is connected to the upper cross beam 12 or the middle cross beam 13 respectively with the springs 5, so that the upper portions and middle portions of the first outer drum 2 and the second outer drum 3 that are integrated together are all connected to the frame 1, thereby ensuring the stability of the first outer drum 2 and/or the second outer drum 3 in the horizontal direction and in the vertical direction, and achieving the objective of firmly mounting the first outer drum 2 and second outer drum 3 by using the middle cross beam 13.

In this embodiment, the second outer drum 3 or the first outer drum 2 is connected to the frame 1 with three dampers 6; and intersections of the three dampers 6 and the frame 1 are located on the same horizontal cross section, and form three vertexes of an isosceles triangle.

As shown in FIGS. 16-18, in this embodiment, the frame 1 further includes a base disposed at the bottom. The base is connected to three dampers 6. Connection points of the three dampers 6 and the base of the washing machine form three vertexes of an isosceles triangle. Therefore, it is implemented that intersections of the dampers 6 configured to support the first outer drum 2 and the second outer drum 3 and the frame 1 form three vertexes of an isosceles triangle, thereby achieving the effect of stably supporting the first outer drum 2 and the second outer drum 3.

In this embodiment, the dampers connected to the lower portion of the second outer drum may also be connected to the lower cross beam (not shown) of the frame, so that connection points of the dampers and the frame form three vertexes of an isosceles triangle.

In this embodiment, an angle formed by the damper 6 and the vertical beam 11 is set to 30-70 degrees. Preferably, angles formed by the three dampers 6 and the vertical beam 11 are set to the same angle value. Therefore, an intersection of axes of two dampers 6 is located on the plane where the axes of the first outer drum 2 and the second outer drum 3 are located, so that the supporting of the dampers on the first outer drum 2 and the second outer drum 3 is more stable.

Embodiment 24

Figure 21:
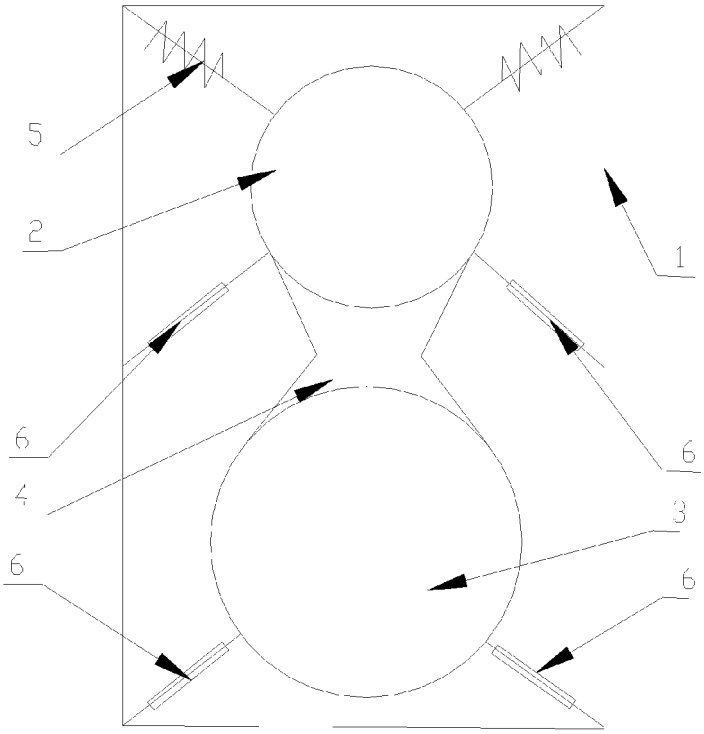
FIG. 21 is a schematic mounting diagram according to Embodiment 24 of the present invention.

As shown in FIG. 21, in this embodiment, the damping apparatus includes that, the first damping device is a spring 5 connected to the upper portion of the first outer drum 2, and the spring 5 is connected to the upper cross beam 13 disposed on the frame 1. The second damping device is a damper 6 connected to the lower portion of the second outer drum 3, and the damper 6 is connected to the lower cross beam 15 disposed on the frame 1. The third damping device is a damper 6 connected to the lower portion of the first outer drum 2, and the damper 6 is connected to the middle cross beam 14 of the frame 1.

Embodiment 25

Figure 22:
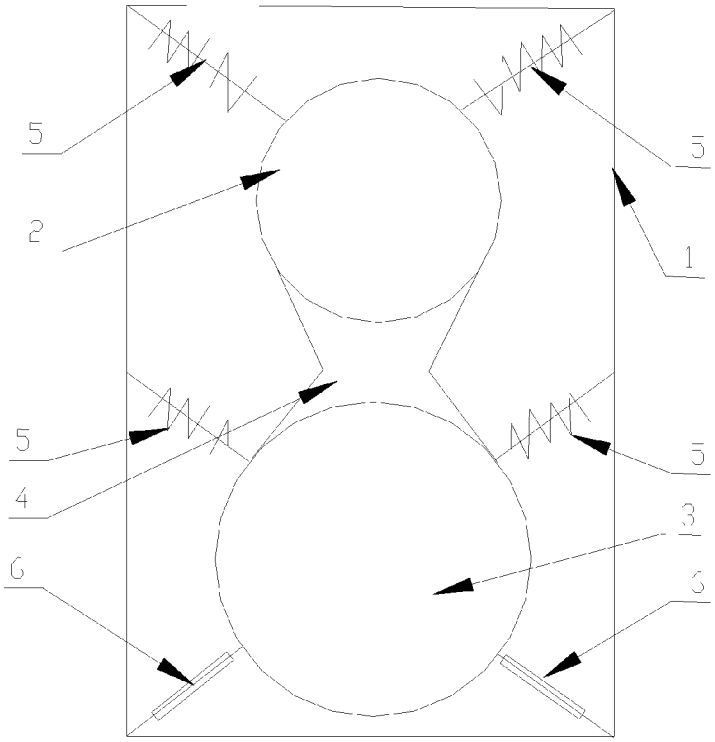
FIG. 22 is a schematic mounting diagram according to Embodiment 25 of the present invention.

As shown in FIG. 22, in this embodiment, the damping apparatus includes that, the first damping device is a spring 5 connected to the upper portion of the first outer drum 2, and the spring 5 is connected to the upper cross beam 13 disposed on the frame 1. The second damping device is a damper 6 connected to the lower portion of the second outer drum 3, and the damper 6 is connected to the lower cross beam 15 disposed on the frame 1. The third damping device is a spring 5 connected to the upper portion of the second outer drum 3, and the spring 5 is connected to the middle cross beam 14 of the frame 1.

Embodiment 26

Figure 23:
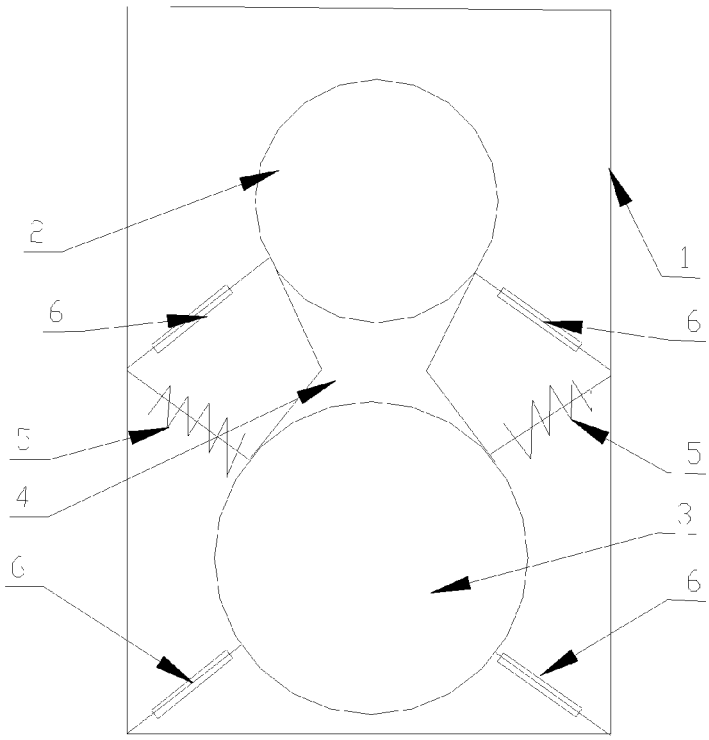
FIG. 23 is a schematic mounting diagram according to Embodiment 26 of the present invention.

As shown in FIG. 23, in this embodiment, the damping apparatus includes that, the first damping device is a damper 6 connected to the lower portion of the first outer drum 2, and the damper 6 is connected to the middle cross beam 14 disposed on the frame 1. The second damping device is a damper 6 connected to the lower portion of the second outer drum 3, and the damper 6 is connected to the lower cross beam 15 disposed on the frame 1. The third damping device is a spring 5 connected to the upper portion of the second outer drum 3, and the spring 5 is connected to the middle cross beam 14 of the frame 1.

While there has been shown several and alternate embodiments of the present invention, it is to be understood that certain changes can be made as would be known to one skilled in the art without departing from the underlying scope of the present invention as is discussed and set forth above and below including claims. Furthermore, the embodiments described above and claims set forth below are only intended to illustrate the principles of the present invention and are not intended to limit the scope of the present invention to the disclosed elements.

What is claimed is:

1. A dual-drum washing machine, comprising:

a frame;

a first outer drum and a second outer drum mounted in the frame;

a connector configured to connect the first outer drum and the second outer drum to form an integral structure;

a first clump weight mounted on the first outer drum;

a second clump weight mounted on the second outer drum, wherein the first clump weight is connected with the second clump weight;

two inner drums respectively disposed in the first outer drum and the second outer drum; and at least two first connection base points integrally disposed on the first outer drum and at least two second connection base points integrally disposed on the second outer drum, wherein the at least two first connection base points and the at least two second connection base points are respectively fixedly connected to the connector; and each of the at least two first connection base points and the at least two second connection base points is a counterweight mounting column;

wherein the first outer drum and the second outer drum that are connected together are connected to the frame through a shared damping apparatus, the damping apparatus comprises a first damping device used to connect the first outer drum to the frame, a second damping device used to connect the second outer drum to the frame, and a third damping device used to connect the first outer drum or the second outer drum to a middle cross beam disposed on the frame.

2. The dual-drum washing machine according to claim 1, wherein a first end of the connector is fixedly connected to the at least two first connection base points disposed at a front end portion of the first outer drum in a detachable manner, and a second end of the connector is fixedly connected to the at least two second connecting base points disposed at a front end portion of the second outer drum in the detachable manner.

3. The dual-drum washing machine according to claim 1, wherein both the first end and the second end of the connector are U-shaped limiting junctions matching with a first profile of the first outer drum and a second profile of the second outer drum, the whole connector is H-shaped or X-shaped, and two limiting ends of the U-shaped limiting junction are each provided with a mounting point correspondingly connected to one of the first connection base points or one of the second connection base points.

4. The dual-drum washing machine according to claim 1, wherein the counterweight mounting columns of the first outer drum or the second outer drum are protruding from the surface of the first outer drum or the second outer drum, the connector is provided with mounting holes corresponding to the counterweight mounting columns, and each of the counterweight mounting columns penetrates through a respective one of the mounting holes and is fixed with a bolt.

5. The dual-drum washing machine according to claim 1, wherein the connector comprises a front connector that connects the front end portions of the first outer drum and the front end portion of the second outer drum, and there is at least one front connector; the front connector is a third clump weight shared by the first outer drum and the second outer drum, or is provided with a fourth clump weight shared by the first outer drum and the second outer drum.

6. The dual-drum washing machine according to claim 1, wherein the connector comprises a rear connector that connects a rear end portion of the first outer drum and a rear end portion of the second outer drum.

* * * * *